United States Patent [19]

Laupot

[11] Patent Number: 4,561,713

[45] Date of Patent: Dec. 31, 1985

[54] LAMP SOCKET BRACKET SYSTEM

[75] Inventor: Richard Laupot, New York, N.Y.

[73] Assignee: Wythe Industries Inc., Clifton, N.J.

[21] Appl. No.: 528,430

[22] Filed: Sep. 1, 1983

[51] Int. Cl.[4] ..... H01R 13/62

[52] U.S. Cl. ..... 339/74 R; 339/256 SP

[58] Field of Search ..... 339/74 R, 256 SP, 258 S

[56] References Cited

U.S. PATENT DOCUMENTS

| | | | |
|---|---|---|---|
| 2,928,063 | 3/1960 | Gammel, Sr. | 339/184 M |
| 2,935,725 | 5/1960 | Fox | 339/184 M |
| 3,204,214 | 8/1965 | Eisert | 339/258 S |
| 3,588,862 | 6/1971 | Brizzi | 339/258 S |
| 3,644,872 | 2/1972 | Russo, Jr. | 339/258 S |
| 3,920,310 | 11/1975 | Walsh et al. | 339/256 SP |
| 4,423,921 | 1/1984 | Hall | 339/258 S |

FOREIGN PATENT DOCUMENTS

| | | | |
|---|---|---|---|
| 993900 | 6/1965 | United Kingdom | 339/258 S |

*Primary Examiner*—Gil Weidenfeld
*Assistant Examiner*—Gary F. Paumen
*Attorney, Agent, or Firm*—Samuelson & Jacob

[57] ABSTRACT

A system for selectively securing a bracket of any one of a variety of configurations to a lamp socket to obtain a desired lamp socket and bracket assembly includes a securing clip affixed to the lamp socket and a securing member on the bracket for being received within the securing clip and locked in place only when the bracket is in a predetermined orientation relative to the lamp socket.

19 Claims, 22 Drawing Figures

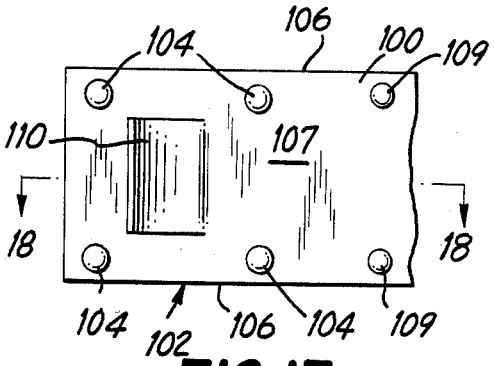
FIG. 17
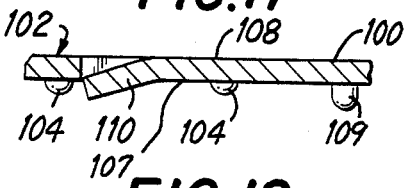
FIG. 18
FIG. 19
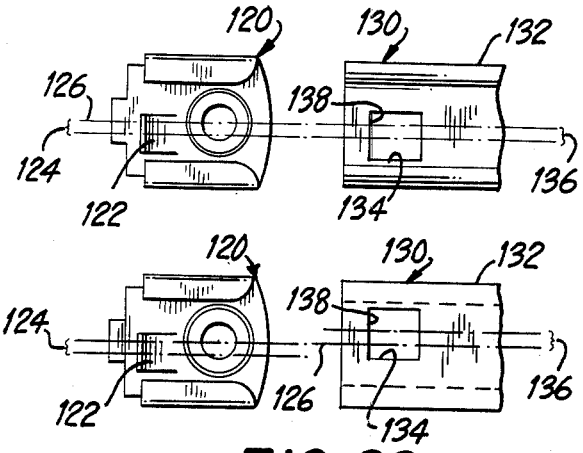
FIG. 20
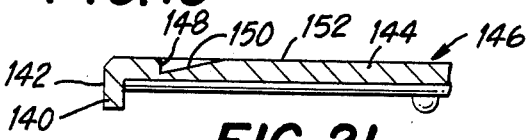
FIG. 21
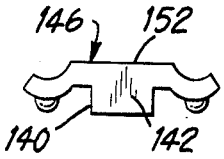
FIG. 22
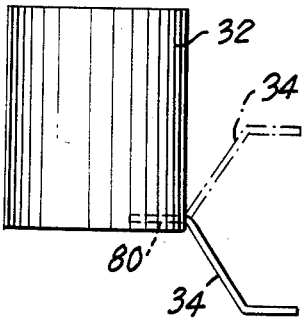
FIG. 11
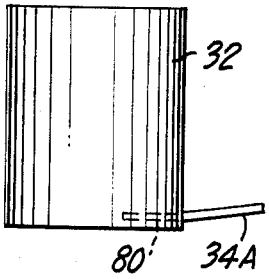
FIG. 12
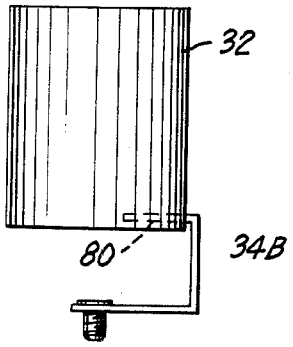
FIG. 13
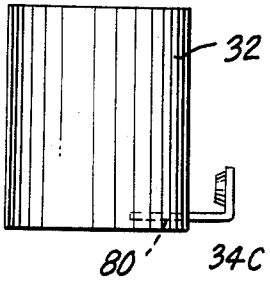
FIG. 14
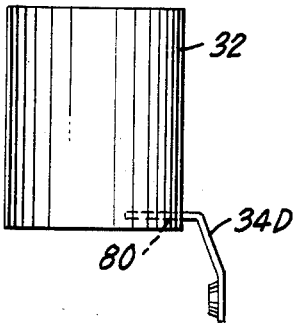
FIG. 15
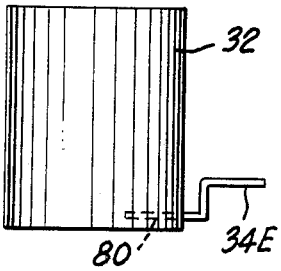
FIG. 16

LAMP SOCKET BRACKET SYSTEM

The present invention relates generally to lamp and lighting fixture construction and pertains, more specifically, to a system for providing lamp sockets with brackets having a wide variety of configurations.

The ever-increasing number and variety of designs and construction in lamps and lighting fixtures has led to enumerable configurations in the brackets employed to mount the lamp sockets utilized in these constructions. Both the manufacture of original equipment and the repair and reconditioning of existing lighting appliances require that a lamp socket having the appropriate bracket configuration be available when needed. Since the lamp sockets and brackets usually are supplied in completely assembled form, with the bracket permanently affixed to the lamp socket, such a requirement often leads to large inventories of lamp socket and bracket assemblies so as to assure that any particular configuration will be available for use at any time.

It would be advantageous to have available a system for selectively securing a bracket of any one of a variety of configurations to a lamp socket in the field so that only the various bracket configurations need be stocked. Since the lamp sockets all would be essentially the same, the number which must be maintained on hand would be reduced. Thus, it would become much more economical to maintain an inventory of diverse configurations in the field. In addition, the actual manufacture of lamp socket and bracket assemblies would be less costly since all of the lamp sockets would be essentially identical, and brackets of any selected configuration would be chosen to fill any particular order for assemblies. However, any system which permits the selective assembly of brackets to lamp sockets must assure that the assembly essentially is foolproof; that is, the bracket must be assembled in correct orientation relative to the lamp socket and must be securely locked in place.

It is an object of the present invention to provide a securing arrangement by which a bracket of any selected one of a plurality of configurations is assembled readily with a lamp socket and secured only in a predetermined orientation relative to the lamp socket.

Another object of the invention is to provide a securing arrangement of the type described and in which a relatively simple securing member is affixed permanently to the lamp socket for receiving any one of a variety of brackets to secure the bracket to the lamp socket in prescribed relationship therewith.

Still another object of the invention is to provide a securing arrangement of the type described and in which the bracket is secured to the lamp socket in a rigid connection of high strength, comparable to conventional connections, with minimal effort and skill.

Yet another object of the invention is to provide a securing arrangement of the type described and which is compatible with currently available conventional lamp socket configurations.

A further object of the invention is to provide a securing member in a securing arrangement of the type described, which securing member is simple and economical in design and construction, and effective in use in connection with currently available lamp socket configurations.

A still further object of the invention is to provide a securing arrangement, as well as securing members in the arrangement, all of which are economical to manufacture in large numbers of consistent high quality.

The above objects, as well as still further objects and advantages, are attained by the present invention which may be described briefly as an improvement in a securing arrangement for securing any selected one of a plurality of brackets to a lamp socket, with the selected bracket secured only in a single predetermined orientation relative to the lamp socket, the improvement comprising: a first securing member of relatively thin, resiliently flexible material for being affixed to the lamp socket, the first securing member having a first surface portion and a first means defining a longitudinal guideway along the first securing member juxtaposed with the first surface portion; a resiliently deflectable locking tab on the first securing member and projecting from the first surface portion into the guideway; a second securing member of relatively thick, inflexible material integral with the selected bracket, the second securing member having a second surface portion and a second guide means complementary to the first guide means for longitudinal engagement of the second securing member with the first securing member to secure the first and second securing members together, with the first and second surface portions confronting one another when the selected bracket is in the single predetermined orientation relative to the lamp socket; a lateral locking edge located on the second securing member for locking abutment with the locking tab upon engagement of the second securing member with the first securing member to lock the first and second securing members against disengagement; and orientation means for allowing locking abutment of the locking edge with the locking tab only upon confrontation of the first and second surface portions and concomitant placement of the bracket at the single predetermined orientation relative to the lamp socket.

The invention will be understood more fully, while additional objects and advantages will be made apparent, in the following detailed description of preferred embodiments of the invention illustrated in the accompanying drawing, in which:

FIG. 11 is an elevational view showing the lamp socket and bracket assembly of FIG. 2;

FIGS. 12 through 16 are elevational views similar to FIG. 11, and illustrating alternate bracket configurations;

FIG. 17 is a fragmentary bottom plan view showing an alternate bracket construction;

FIG. 18 is a cross-sectional view taken along line 18—18 of FIG. 17;

FIG. 19 is a plan view showing an alternate construction for the clip and the bracket;

FIG. 20 is a plan view similar to FIG. 19, but showing the bracket in inappropriate orientation;

FIG. 21 is a longitudinal cross-sectional view of a portion of another bracket constructed in accordance with the invention; and FIG. 22 is an end elevational view of the bracket.

Figure 1:
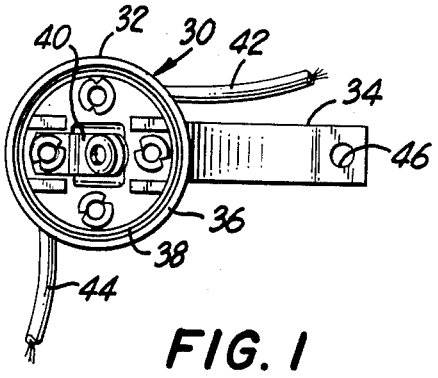
FIG. 1 is a top plan view of a lamp socket and bracket assembly.

Referring now to the drawing, and especially to FIG. 1, thereof, an assembly 30 is shown to include a lamp socket 32 and a bracket 34 secured to the lamp socket 32. Lamp socket 32 is of conventional design and construction and has a dielectric shell 36 within which there is affixed a conductive, threaded socket element 38 and an electrical contact 40 for making the appropriate electrical connections between electrical leads 42, 44 and a light bulb (not shown) to be threaded into the lamp socket 32. Bracket 34 will support the lamp socket 32 itself within a lamp or lighting fixture (not shown), a hole 46 being provided in the bracket 32 to receive a suitable fastener for that purpose.

Figure 2:
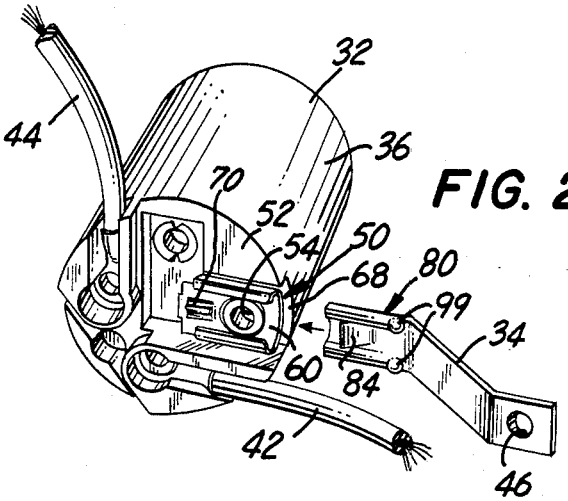
FIG. 2 is a perspective view of the lamp socket and bracket about to be assembled with a securing arrangement constructed in accordance with the invention.
Figure 3:
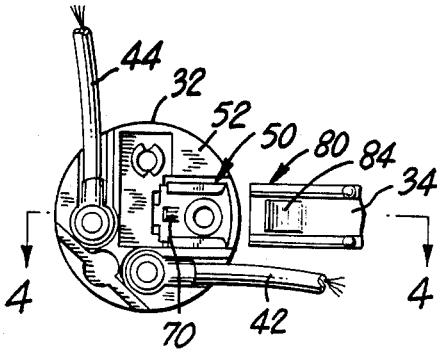
FIG. 3 is a bottom view of the lamp socket and bracket about to be assembled.
Figure 4:
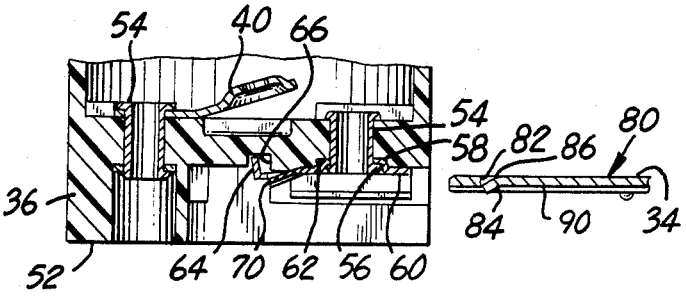
FIG. 4 is an enlarged fragmentary cross-sectional view taken along line 4—4 of FIG. 3.

Turning now to FIGS. 2, 3 and 4, rather than the usual eyeleted or riveted connection generally found in conventional lamp socket and bracket assemblies, bracket 34 is to be secured to lamp socket 32 by means of a securing system in which a first securing member is affixed permanently to the lamp socket 32 and a second securing member is placed on the bracket 34 so that a bracket 34 of any selected configuration, chosen from a variety of configurations, may be secured to the lamp socket 32 at any time, in the manner shown. Thus, the first securing member is illustrated in the form of a clip 50 affixed to the base 52 of dielectric shell 36 by means of an eyelet 54 which passes through affixing means in the form of an opening 56 in a boss 58 raised from web 60 of clip 50, which boss 58 is seated in a complementary depression 62 in base 52 of shell 36. A finger 64 projects upwardly from web 60 and is received within a recess 66 in base 52 to aid in positioning the clip 50 longitudinally on the base 52. Clip 50 is located in a slot 68 in base 52 for positioning the clip 50 laterally. Thus, clip 50 is located accurately and affixed securely to the base 52 of shell 36.

Figure 5:
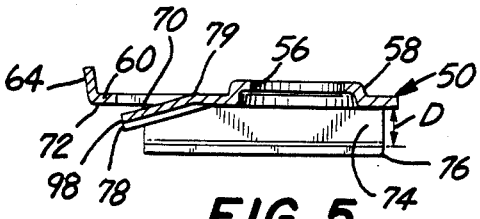
FIG. 5 is a longitudinal cross-sectional view of a securing clip constructed in accordance with the invention.
Figure 6:
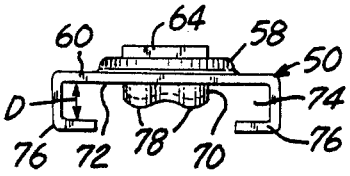
FIG. 6 is an end elevational view of the clip.

As best seen in FIGS. 5 and 6, clip 50 includes a tab 70 struck from web 60 and projecting downwardly from lower surface 72 of web 60 into a longitudinally-extending guideway 74 established by opposed channel members 76 extending along the opposite longitudinal edges of web 60 of clip 50. Clip 50 preferably is constructed of a relatively thin, resiliently flexible material, such as spring steel, so that tab 70 is resiliently deflectable upwardly toward web 60. Tab 70 preferably is permanently formed into a somewhat corrugated cross-sectional configuration, with longitudinal corrugations 78 serving to reinforce the tab 70 so that flexing of the tab 70 will take place essentially at the root 79 of the tab 70, and the tab will resist bending along the length of the tab.

Figure 7:
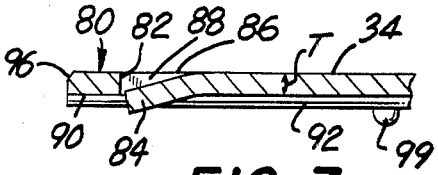
FIG. 7 is a longitudinal cross-sectional view of a portion of a bracket constructed in accordance with the invention.
Figure 8:
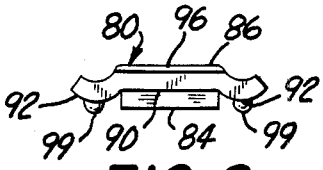
FIG. 8 is an end elevational view of the bracket.

Referring now to FIGS. 7 and 8, as well as to FIGS. 2 through 6, the second securing member is shown in the form of an end portion 80 of bracket 34. A laterally-extending locking edge 82 is established in end portion 80 by striking a tongue 84 downwardly away from upper surface 86, thereby creating an aperture 88, with locking edge 82 located along the upper peripheral edge of the aperture 88. Bracket 34 is constructed of a relatively thick, rigid material, as compared to the thin, resiliently flexible material of clip 50, and tongue 84 is relatively inflexible. Tongue 84 does not project downwardly beyond the lower surface 90 of end portion 80 and blocks access to aperture 88 from lower surface 90, for reasons which will be set forth below. Longitudinal ribs 92 extend along the opposite longitudinal edges of end portion 80 and project altitudinally downwardly from lower surface 90.

Figure 9:
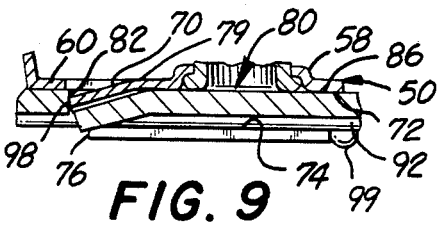
FIG. 9 is a longitudinal cross-sectional view showing the bracket assembled with the clip, the bracket being illustrated in appropriate orientation.

In order to assemble bracket 34 with lamp socket 32, end portion 80 of the bracket merely is inserted into the guideway 74 of clip 50, with the bracket 34 oriented so that upper surface 86 confronts lower surface 72 of web 60. The altitudinal depth D of the guideway 74 is somewhat greater than the thickness T of the end portion 80 so that insertion is facilitated. As end portion 80 is so inserted, a bevel 96 at the leading edge of upper surface 86 of end portion 80 not only will facilitate the insertion, but subsequently will deflect tab 70 of clip 50 upwardly to allow passage of the end portion 80 into the guideway 74. At the same time, ribs 92 fit within channel members 76 to bias the upper surface 86 altitudinally toward lower surface 72 of web 60 so as to compensate for the relative dimensions of depth D and thickness T and hold the end portion 80 securely within clip 50. Once the bracket 34 is fully assembled with lamp socket 32, with end portion 80 located at the secured position illustrated in FIG. 9, tab 70 will spring into aperture 88 and the tip 98 of the tab will abut locking edge 82 to lock the end portion 80 in place within guideway 74, as seen in FIG. 9, against retraction of the bracket 34 from the clip 50. In this manner, bracket 34 is secured to lamp socket 32 at the secured position. It is noted that tab 70 is confined by tongue 84 to aperture 88 so that the tip 98 of the tab 70 will be maintained in abutment with locking edge 82, thereby reinforcing and rendering quite rigid the locking arrangement provided by tab 70 and locking edge 82. In the absence of the relatively rigid tongue 84, manufacturing tolerances might enable the tip 98 of tab 70 to drop below lower surface 90 of end portion 80 so that upon attempted retraction of the bracket 34, tab 70 could flex downwardly and permit some retractive movement away from the secured position. Tongue 84 thus precludes any retraction of bracket 34 and renders the securing arrangement more rigid. In addition, the corrugated configuration of tab 70 assures abutment of tip 98 with locking edge 82 even if there is some variation in the elevation of tab 70 relative to lower surface 72, and stiffens the tab against bending so as to further preclude retraction of the bracket 34. Stop members 99 are placed on the end portion 80 and project downwardly from the ribs 92 to abut the clip 50 at channel members 76, once the bracket 34 is assembled properly with clip 50, to preclude further advancement of the bracket within the clip and to further assure a rigid, vibration-free assembly.

Figure 10:
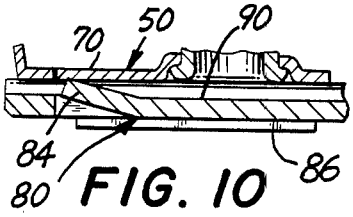
FIG. 10 is a longitudinal cross-sectional view showing the bracket assembled with the clip, the bracket being illustrated in inappropriate orientation.

Assembly of bracket 34 and lamp socket 32 with the bracket in improper orientation relative to the lamp socket is precluded by rigid tongue 84 which serves as orientation means for assuring proper orientation of bracket 34 in assembly 30. Thus, should an attempt be made to insert end portion 80 of bracket 34 within clip 50 in upside-down orientation, that is, with lower surface 90 of the end portion confronting lower surface 72 of web 60, as illustrated in FIG. 10, tongue 84 will block access to aperture 88 by tab 70 so that tab 70 will be unable to enter aperture 88 and will be ineffective to lock end portion 80, and bracket 34, within clip 50. Hence, even a worker of limited skill will have no difficulty in ascertaining the appropriate orientation of bracket 34 in the completed assembly 30. In addition, once tab 70 is in locking engagement with locking edge 82, tongue 84 blocks access to the tab 70 so that the tab cannot be pushed out of locking engagement with locking edge 82, thereby rendering the connection between the bracket 34 and the lamp socket 32 mechanically equivalent to a conventional permanent connection.

In FIG. 11, assembly 30 is shown with bracket 34 secured to lamp socket 32 in the correct orientation. If bracket 34 could be secured in upside-down orientation, as shown in phantom in FIG. 11, assembly 30 would have an incorrect configuration.

As shown in FIGS. 12 through 16, lamp socket 32 may be assembled with any one of a plurality of brackets 34A, 34B, 34C, 34D or 34E having different configurations for use in a particular lamp or lighting fixture. Each of the brackets is provided with an end portion 80 so that the bracket is assembled with the lamp socket by merely inserting end portion 80 into the clip 50 affixed to the lamp socket 32. The assembly of a bracket with a lamp socket can be accomplished either in the factory or in the field without the requirement for special equipment or training. Hence, it becomes possible to stock a lesser number of lamp sockets 32, while having access to a variety of brackets 34, to enable the expeditious supply of an assembly 30 of a particular selected configuration.

Turning now to FIGS. 17 and 18, a bracket 100 is seen to have an alternate construction in that the end portion 102 includes a plurality of domed protrusions 104, instead of longitudinal ribs, adjacent the longitudinal edges 106 of the end portion 102. Protrusions 104 project altitudinally from the lower surface 107 of the end portion 102 and will engage the channel members 76 of clip 50 to bias the upper surface 108 of the end portion 102 upwardly against the confronting lower surface 72 of web 60 of clip 50. Further protrusions 109 provide stop members, as described in connection with the above-described embodiment. Tongue 110 again serves the same functions as tongue 84 of the earlier-described embodiment.

Referring now to FIGS. 19 and 20, an alternate orientation means is shown in the form of an offset arrangement. In the embodiment illustrated in FIGS. 19 and 20, the first securing member is in the form of a clip 120 provided with a resiliently deflectable tab 122 located at a lateral offset 124 relative to the longitudinal centerline 126 of clip 120. The second securing member is in the form of an end portion 130 of a bracket 132. End portion 130 includes an aperture 134 located at a lateral offset 136 relative to the same longitudinal centerline 126 and provides a laterally offset locking edge 138. When bracket 132 is in the proper orientation, as seen in FIG. 19, the tab 122 and locking edge 138 are aligned for appropriate locking engagement when the end portion 130 is inserted into the clip 120.

Should end portion 130 be inserted into clip 120 when bracket 132 is improperly oriented, as shown by the upside-down position in FIG. 20, the locking edge 138 and tab 122 will be offset laterally in opposite directions from centerline 126 and tab 122 will not engage locking edge 138 to lock end portion 130, and bracket 132, in place within clip 120. Since aperture 134 is not provided with a tongue, as in the earlier-described embodiments, the construction of end portion 138 is somewhat simplified; however, the further advantages attained by the presence of a tongue are not found in the instant embodiment.

Still another alternate orientation means is illustrated in FIGS. 21 and 22 in the form of an altitudinally downwardly projecting finger 140 placed at the forward end 142 of end portion 144 of alternate bracket 146. End portion 144 includes a locking edge 148 established by a depression 150 at the upper surface 152 of the end portion 144, which depression will receive tab 70 of clip 50 to lock the end portion 144 of bracket 146 in place within the clip 50. Upon insertion of end portion 144 into the guideway 74 in proper orientation, finger 140 will pass between channel members 76 of the clip 50 and enable the assembly of bracket 146 with clip 50. However, any attempt to insert end portion 144 in upside-down orientation will be precluded by the abutment of finger 140 with shell 36 of lamp socket 32, since the finger 140 will project upwardly under those conditions. In this instance, the end portion 144 will not even enter the guideway 74 and the inappropriate orientation will be made apparent.

It will be seen, then, that a system is provided for selectively securing a bracket of any one of a plurality of configurations to a lamp socket, with the bracket in appropriate orientation relative to the lamp socket, with ease and economy and without the necessity for specialized tools or a high degree of skill. The connection between the bracket and lamp socket is strong and rigid and allows increased flexibility in the provision of an inventory sufficient to supply lamp socket and bracket assemblies as required.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are as follows:

1. In a securing arrangement for securing any selected one of a plurality of brackets to a lamp socket, with the selected bracket secured only in a single predetermined orientation relative to the lamp socket, the improvement comprising:

a first securing member of relatively thin, resiliently flexible material for being affixed to the lamp socket, the first securing member having a first surface portion and a first guide means defining a longitudinal guideway along the first securing member juxtaposed with the first surface portion;

a resiliently deflectable locking tab on the first securing member and projecting from the first surface portion into the guideway;

a second securing member of relatively thick, inflexible material integral with the selected bracket, the second securing member having a second surface portion, a second guide means complementary to the first guide means for longitudinal engagement of the second securing member with the first securing member to secure the first and second securing members together, with the first and second surface portions confronting one another when the selected bracket is in the single predetermined orientation relative to the lamp socket, a further surface portion opposite the second surface portion, and an aperture extending between the second surface portion and the further surface portion;

a lateral locking edge located on the second securing member along a portion of the periphery of the aperture for locking abutment with the locking tab upon engagement of the second securing member with the first securing member to lock the first and second securing members against disengagement; and orientation means for allowing locking abutment of the locking edge with the locking tab only upon confrontation of the first and second surface portions and concomitant placement of the bracket at the single predetermined orientation relative to the lamp socket, the orientation means including a relatively rigid, non-deflectable tongue on the second securing member and projecting into the aperture adjacent the further surface portion so as to block access to the locking edge by the locking tab upon confrontation of the further surface portion with the first surface portion as a result of orientation of the bracket with the lamp socket in other than the single predetermined orientation.

2. The invention of claim 1 wherein the tongue is unitary with the second securing member.

3. The invention of claim 1 wherein the locking tab is unitary with the first securing member.

4. The invention of claim 3 wherein the locking tab includes longitudinally extending reinforcing means for reinforcing the locking tab against altitudinal bending along the length of the locking tab.

5. The invention of claim 4 wherein the reinforcing means includes at least one longitudinal corrugation.

6. The invention of claim 1 wherein the first guide means includes opposed guide channel members on the first securing member, and the second guide means includes an end portion complementary with the guide channel members, the end portion including said further surface portion opposite the second surface portion.

7. The invention of claim 6 including at least one stop member on the end portion of the second securing member for abutting the first securing member when the second securing member is secured to the first securing member to preclude further longitudinal movement of the second securing member relative to the first securing member in the direction of the longitudinal engagement of the second securing member with the first securing member.

8. The invention of claim 6 including biasing means for biasing the end portion altitudinally relative to the guide channel members to hold the end portion securely within the guide channel members.

9. The invention of claim 8 wherein the biasing means includes longitudinal ribs on the end portion and projecting altitudinally from the further surface portion.

10. The invention of claim 8 wherein the biasing means includes domed protrusions on the end portion and projecting altitudinally from the further surface portion.

11. In a securing arrangement for securing any selected one of a plurality of brackets to a lamp socket, with the selected bracket secured only in a single predetermined orientation relative to the lamp socket, the improvement comprising:

a first securing member of relatively thin, resiliently flexible material for being affixed to the lamp socket, the first securing member having a first surface portion and a first guide means defining a longitudinal guideway along the first securing member juxtaposed with the first surface portion;

a resiliently deflectable locking tab on the first securing member and projecting from the first surface portion into the guideway;

a second securing member of relatively thick, inflexible material integral with the selected bracket, the second securing member having a second surface portion and a second guide means complementary to the first guide means for longitudinal engagement of the second securing member with the first securing member to secure the first and second securing members together, with the first and second surface portions confronting one another when the selected bracket is in the single predetermined orientation relative to the lamp socket;

a lateral locking edge located on the second securing member for locking abutment with the locking tab upon engagement of the second securing member with the first securing member to lock the first and second securing members against disengagement; and orientation means for allowing locking abutment of the locking edge with the locking tab only upon confrontation of the first and second surface portions and concomitant placement of the bracket at the single predetermined orientation relative to the lamp socket;

the second securing member including a further surface portion opposite the second surface portion; and the orientation means including a finger projecting altitudinally beyond the further surface portion for precluding longitudinal engagement of the second securing member with the first securing member, with the further surface portion confronting the first surface portion.

12. A securing member of relatively thick, inflexible material for use in a securing arrangement for securing any selected one of a plurality of brackets to a lamp socket, with the selected bracket secured only in a single predetermined orientation relative to the lamp socket, the securing arrangement including a securing clip of relatively thin, resiliently flexible material affixed to the lamp socket, the securing clip having a first surface portion and a first guide means defining a longitudinal guideway along the securing clip juxtaposed with the first surface portion and a resiliently deflectable locking tab on the securing clip and projecting from the first surface portion into the guideway, the securing member being integral with the selected bracket; the securing member comprising:

a second surface portion and a second guide means complementary to the first guide means for longitudinal engagement of the securing member with the securing clip to secure the clip and the securing member together, with the first and second surface portions confronting one another when the selected bracket is in the single predetermined orientation relative to the lamp socket;

a lateral locking edge located on the securing member for locking abutment with the locking tab upon engagement of the securing member with the securing clip to lock the securing member against disengagement from the clip;

a further surface portion opposite the second surface portion;

an aperture extending between the second surface portion and the further surface portion to establish the locking edge located along a portion of the periphery of the aperture; and orientation means for allowing locking abutment of the locking edge with the locking tab only upon confrontation of the first and second surface portions and concomitant placement of the bracket at the single predetermined orientation relative to the lamp socket, the orientation means including a relatively rigid, non-deflectable tongue on the securing member and projecting into the aperture adjacent the further surface portion so as to block access to the locking edge by the locking tab upon confrontation of the further surface portion with the first surface portion as a result of orientation of the bracket with the lamp socket in other than the single predetermined orientation.

13. The invention of claim 12 wherein the tongue is unitary with the securing member.

14. The invention of claim 12 wherein the first guide means includes opposed guide channel members on the securing clip and the second guide means includes an end portion complementary with the guide channel members, the end portion including said further surface portion opposite the second surface portion.

15. The invention of claim 14 including at least one stop member on the end portion of the securing member for abutting the securing clip when the securing member is secured to the securing clip to preclude further longitudinal movement of the securing member relative to the securing clip in the direction of the longitudinal engagement of the securing member with the securing clip.

16. The invention of claim 14 including biasing means for biasing the end portion altitudinally relative to the guide channel members to hold the end portion securely within the guide channel member.

17. The invention of claim 16 wherein the biasing means includes longitudinal ribs on the end portion and projecting altitudinally from the further surface portion.

18. The invention of claim 16 wherein the biasing means includes domed protrusions on the end portion and projecting altitudinally from the further surface portion.

19. A securing member of relatively thick, inflexible material for use in a securing arrangement for securing any selected one of a plurality of brackets to a lamp socket, with the selected bracket secured only in a single predetermined orientation relative to the lamp socket, the securing arrangement including a securing clip of relatively thin, resiliently flexible material affixed to the lamp socket, the securing clip having a first surface portion and a first guide means defining a longitudinal guideway along the securing clip juxtaposed with the first surface portion and a resiliently deflectable locking tab on the securing clip and projecting from the first surface portion into the guideway, the securing member being integral with the selected bracket, the securing member comprising:

a second surface portion and a second guide means complementary to the first guide means for longitudinal engagement of the securing member with the securing clip to secure the clip and the securing member together, with the first and second surface portions confronting one another when the selected bracket is in the single predetermined orientation relative to the lamp socket;

a lateral locking edge located on the securing member for locking abutment with the locking tab upon engagement of the securing member with the securing clip to lock the securing member against disengagement from the clip; and orientation means for allowing locking abutment of the locking edge with the locking tab only upon confrontation of the first and second surface portions and concomitant placement of the bracket at the single predetermined orientation relative to the lamp socket;

the securing member including a further surface portion opposite the second surface portion; and the orientation means including a finger projecting altitudinally beyond the further surface portion for precluding longitudinal engagement of the securing member with the securing clip, with the further surface portion confronting the first surface portion.

* * * * *